US010046478B2

(12) United States Patent
White et al.

(10) Patent No.: US 10,046,478 B2
(45) Date of Patent: Aug. 14, 2018

(54) METHOD FOR DENSIFYING A FIBROUS MAT

(71) Applicant: SCRIMTEC HOLDINGS, LLC, Shuqualak, MS (US)

(72) Inventors: James Michael White, Meridian, MS (US); Roy Daniel Seale, Starkville, MS (US); Don Roberts Clark, Witts Springs, AR (US)

(73) Assignee: SCRIMTEC HOLDINGS, LLC, Shuqualak, MS (US)

( * ) Notice: Subject to any disclaimer, the term of this patent is extended or adjusted under 35 U.S.C. 154(b) by 994 days.

(21) Appl. No.: 14/317,537

(22) Filed: Jun. 27, 2014

(65) Prior Publication Data

US 2015/0115493 A1 Apr. 30, 2015

Related U.S. Application Data

(62) Division of application No. 13/023,082, filed on Feb. 8, 2011, now Pat. No. 8,776,681.

(51) Int. Cl.

| | |
|---|---|
| ***B27N 3/12*** | (2006.01) |
| ***B27N 3/10*** | (2006.01) |
| ***B30B 13/00*** | (2006.01) |
| ***B30B 5/00*** | (2006.01) |

(52) U.S. Cl.

CPC ..... *B27N 3/12* (2013.01); *B27N 3/10* (2013.01); *B30B 5/00* (2013.01); *B30B 13/00* (2013.01)

(58) Field of Classification Search

CPC ..... B30B 13/00; B30B 5/00; B27N 3/143; B27N 3/04; B27N 3/146; B27N 3/12; B27D 1/10; B31F 1/2877; Y10T 156/1075

USPC ..... 100/35, 43, 214, 200, 202; 156/583.8, 156/583.91; 144/352, 361

See application file for complete search history.

(56) References Cited

U.S. PATENT DOCUMENTS

| | | | | |
|---|---|---|---|---|
| 3,396,843 | A * | 8/1968 | Allen | B65B 63/00 209/668 |
| 4,212,616 | A | 7/1980 | Tilby | |
| 4,364,984 | A | 12/1982 | Wentworth | |
| 4,976,905 | A * | 12/1990 | Brown | B27N 3/08 264/115 |
| 5,060,806 | A | 10/1991 | Savage | |
| 5,279,691 | A | 1/1994 | Stickland | |

(Continued)

OTHER PUBLICATIONS

Search Report and Written Opinion for International Patent Application No. PCT/US2012/024321; dated May 29, 2012.

*Primary Examiner* — Jimmy T Nguyen

(74) *Attorney, Agent, or Firm* — Barnes & Thornburg LLP; Jason Bernstein

(57) ABSTRACT

A method for densifying a fibrous mat, such as scrim, to achieve a uniform mat density, including a set of parallel bars each having a row of pins extending downward therefrom which can engage the mat fibers, a plurality of shafts along which the bars slide so as to maintain the bars parallel, a plurality of extendable accordion linkages connecting the set of bars, and a linear positioning assembly having a reciprocating drive mechanism coupled to one of the bars which can move the bars in response to an actuation signal. As the drive mechanism retracts the bar to which it is coupled the spacing between the rows of bars is decreased uniformly and the rows of pins draw the fibers together and compress them uniformly across the width of the mat.

14 Claims, 12 Drawing Sheets

(56) References Cited

U.S. PATENT DOCUMENTS

| | | | | |
|---|---|---|---|---|
| 7,291,243 | B2 | 11/2007 | Adami | |
| 8,468,715 | B2 | 6/2013 | Thomas, Jr. et al. | |
| 8,776,681 | B2 * | 7/2014 | White | B27N 3/12 100/200 |
| 2004/0261950 | A1 | 12/2004 | Adami | |

* cited by examiner

METHOD FOR DENSIFYING A FIBROUS MAT

CROSS-REFERENCE TO RELATED APPLICATION

This application is a divisional of co-pending U.S. patent application Ser. No. 13/023,082, filed Feb. 8, 2011, now U.S. Pat. No. 8,776,681, the disclosure of which is incorporated herein by reference in its entirety.

FIELD

The present disclosure generally relates to apparatus used in forming engineered wood products. More particularly, the present disclosure relates to an apparatus for compressing a fibrous mat to achieve a uniform density.

BACKGROUND

Processing the trees into engineered products involves a number of steps. One of the steps is crushing young trees (stripped of branches) to obtain loose bundles of fibrous strands. The bundles of fibers are formed into mats of crushed fibers with the fibers being generally parallel. Resin is added as well as other binding agents and the mat is dried under pressure to eventually reach a target moisture content and density. After the fibers are formed into mats and before resin is added the mats must be processed to provide a uniform density of fibers across the width W (i.e., perpendicular to the direction of the fibers, see FIG. 1) of the mat.

It is important for the mat to have a uniform density of fibers across the entire mat width W so that the resulting wood product has uniform and predictable strength. Density variation can cause failure of the wood product in use, which can have disastrous effects where the wood product is load bearing.

Old growth unprocessed wood generally has been more desirable for making engineered wood products than new growth unprocessed wood or pulpwood, in part because of the lower moisture content of older trees. Pulpwood is commonly defined as wood that is about 12-60 years of age or of a certain diameter (to be distinguished from veneer or dimension lumber). Old growth trees are rapidly vanishing as forests are depleted. New "immature" tree farms are increasing in development to provide a nearly limitless source of such wood. Such farms can grow trees at a faster rate using modern technology. Immature trees can be harvested at a younger age than old grow trees, however, there is a greater variation of fiber density in immature trees than in old growth trees, resulting in a need for improved methods of producing uniform density mats.

One type of conventional apparatus which attempts to create a uniform density mat of fibers utilizes a pair of parallel vertical opposing plates between which is inserted a mat coming off, for example, a scrim line, to be compressed (also referred to as "densified"). One or both plates are connected to a reciprocating drive mechanism which drives the plates toward each other, compressing the fibrous mat therebetween. A challenge with this apparatus is that the compressive force is applied to the front and rear edges (4, 6 in FIG. 1) of the mat proximate to the plates, but the compressive force is not evenly applied across the width of the mat. The result can be that the mat has a higher density near the front and rear edges and lower density in the middle of the mat. Additionally, a nonuniform density mat may tend to decompress over time. If the density is not consistent, the moisture content of the mat after drying is not consistent, which affects the rest of the manufacturing process and the performance characteristics of the final wood product. Delamination can result if the moisture content is too high; insufficient bonding can result if the moisture content is too low. In a veneer production process, if the mat thickness varies, the veneer thickness can vary. In a sawmill operation, the result of inconsistent density can be inconsistent wood dimensions.

It would be desirable to have an apparatus which could densify a fibrous mat uniformly across the mat and improve the resulting strength characteristics. It would also be desirable to use density to control moisture content.

SUMMARY

In one exemplary embodiment of the present disclosure an apparatus is provided for uniformly densifying a fibrous mat. A densifying assembly includes a set of parallel bars each having a row of pins extending downward therefrom which can engage the mat fibers, a plurality of shafts along which the bars slide so as to maintain the bars parallel, a plurality of extendable accordion linkages connecting the set of bars, and a linear positioning assembly having a reciprocating drive mechanism coupled to one of the bars which can move the bars in response to an actuation signal. As the drive mechanism retracts the bar to which it is coupled the spacing between the rows of bars is decreased uniformly and the rows of pins draw the fibers together and compress them uniformly across the width of the mat.

In another exemplary embodiment an apparatus is provided including a carriage frame having front and rear rails, left and right side rails, a plurality of downwardly extending brackets, each bracket having a roller mounted thereon by a bearing. The apparatus further includes a densifier assembly comprising a plurality of generally parallel elongated bars comprising a plurality of passive bars disposed between a drive bar and a static bar, the static bar being connected to the carriage frame, a plurality of pins associated with and extending downward from the drive bar and each of the passive bars; a plurality of extendable and retractable accordion linkages arranged generally parallel to each other and generally perpendicular to the bars, each accordion linkage being associated with at least one point on each bar, the accordion linkages being adapted to maintain each row of elongated bars in a generally parallel relationship to each other and permitting the distance between the bars to expand or contract proportionately so that the spacing between the rows of bars is equal while the overall spacing between adjacent bars increases or decreases, and a plurality of shafts slidingly associated with the passive bars and the drive bar and fixedly associated at one end with the static bar; at least one linear positioning assembly having a reciprocating drive member having a first and a second end, the first end being attached to the carriage frame, a coupler for coupling the second end of the reciprocating drive member to the drive bar, and, a motor operatively associated with the reciprocating drive member; a vertical positioning assembly including at least one support plate connected to the frame, and at least one reciprocating drive mechanism connected to the at least one support plate for raising and lowering the bars; a main frame having at least four legs, a pair of front and rear members, a pair of opposing side members, the densifier assembly and carriage frame being slidingly positioned and the rollers resting on the pair of side members, a conveyor, and a reciprocating drive mechanism connected to the main frame and to the carriage assembly; a weight detector for weighing the mat to obtain weight data; a surface area sensor for detecting the surface and edges of the mat to obtain square footage data; and, a processor in communication with the weight detector and the surface area sensor for calculating a densification value based on the weight and square footage data indicating the distance the drive bar must travel in order to provide a desired densification. The drive bar is reciprocatingly slidable in response to actuation by the linear positioning assembly motor and drive shaft. The rows of pins are insertable in the mat and when the drive bar is urged toward the static bar the passive bars move so as to decrease the distance between rows of bars and cause the pins which are inserted into a mat to compress the mat in a direction across the face of the mats and generally uniformly along the length of the mat.

In another embodiment of the present disclosure, the apparatus described hereinabove further includes a stripper assembly for removing fibrous material which may adhere to the pins after removal of the pins from the mat when the densification has been achieved. The stripper subassembly assembly includes a frame; a plurality of stripper members associated with the frame; a plurality of gaps defined in the stripper members, a pin being insertable into and removable from a gap; a positioning mechanism for raising and lowering the frame and stripper members with respect to the pins such that the stripper members are proximate to the pins and strip the pins of fibers or other material when the pins pass through the gaps.

In another embodiment of the present disclosure, an apparatus is provided for densifying a mat having fibers aligned in a generally parallel direction and having a front edge and a rear edge parallel to the direction of the fibers whereby the distance between the front and rear edges defines the width of the mat, the apparatus including means for providing a uniform compressive force to the mat, the compressive force being applied at a plurality of points throughout the mat and substantially the entire width of the mat so as apply substantially the same compressive force to substantially all the fibers at the same time so as to achieve a substantially uniformly densified mat.

Another embodiment of the present disclosure provides a method for increasing the density of a fibrous mats, the mat having a grain defined as the direction of the face of the mat, comprising (a) weighing a mat to obtain weight data; (b) scanning the mat with a detection device to obtain square footage data; (c) determining from the weight and square footage data a densification value indicating how much the mat is to be compressed; (d) actuating an apparatus for increasing the density of the mat, the apparatus being as described hereinabove; and, (e) moving the rows of pins so as to compress the mat substantially uniformly across the grain of the mat. The method may also include a step (f) moving the compressed mat of step e) away from the linear positioning apparatus and toward a location for stacking a plurality of compressed mats. The method may also include a step (g) resetting the rows of pins to accommodate another mat. The method may also include a step (h) assembling a plurality of sets of compressed mats and cutting the sets of mats to a desired length.

Another embodiment of the present disclosure provides a mat formed by the method disclosed herein. The mat has a substantially uniform density. The mat also has substantially uniform moisture content.

A feature of the apparatus of the present disclosure is that by controlling densification of the mat during processing, the moisture content can be controlled.

BRIEF DESCRIPTION OF THE DRAWINGS

The invention is illustrated in the drawings in which like reference characters designate the same or similar parts throughout the figures of which.

DETAILED DESCRIPTION

Overall Apparatus

Figure 1:
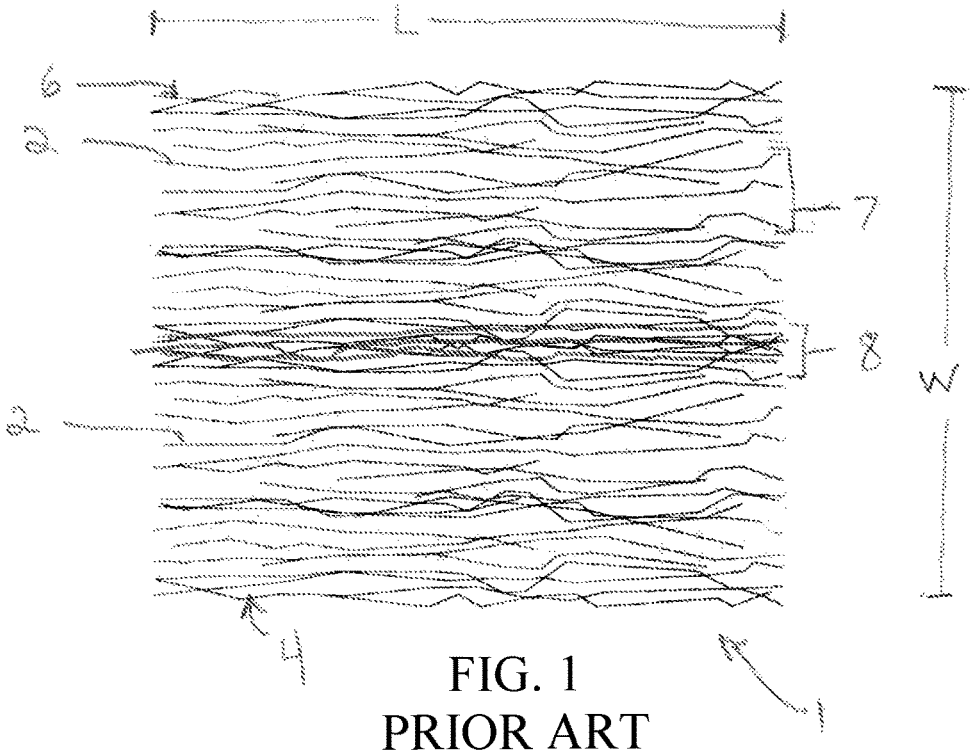
FIG. 1 PRIOR ART
FIG. 1 is a schematic top plan view of an undensified mat.
Figure 2:
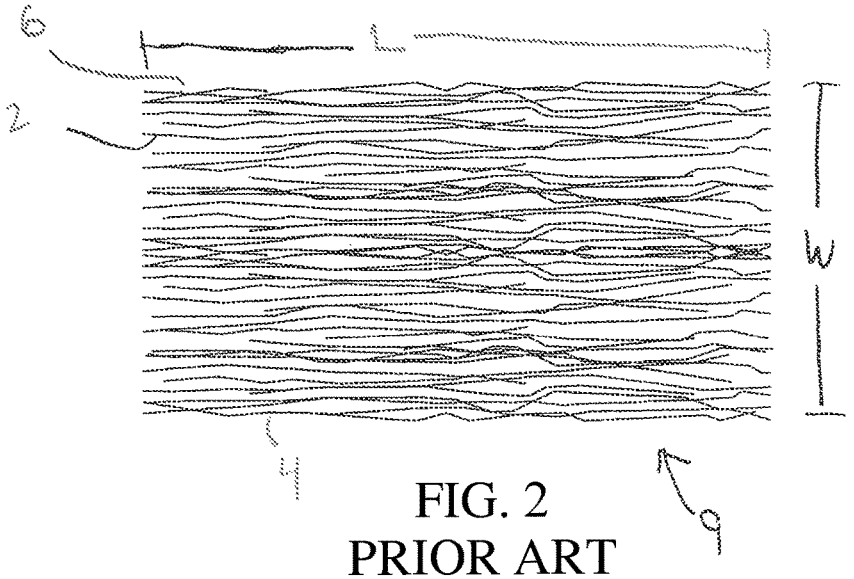
FIG. 2 PRIOR ART
FIG. 2 is a schematic top plan view of a densified mat.

Steam press scrim lumber ("SPSL") is composed of processed mats of fibers obtained by crushing and processing logs of generally small diameters. A conventional mat 1 (see FIGS. 1 and 2) is made of fibers 2 and is several inches thick. The mat 1 has a front edge 4, a rear edge 6, width W and length L. An uncompressed mat 1 which is still being processed may have different areas in the mat having areas of relatively low fiber density 7 and regions of relatively higher fiber density 8. This is common for many unfinished mats. See, for example, the process described in co-pending U.S. patent application Ser. No. 12/579,332 entitled "Method for Drying Wood Product and Product Obtained Thereby" commonly assigned to the assignee of the present disclosure (and which is incorporated by reference herein in its entirety). Often individual mats 1 are gathered together to form a set of mats for further processing. The densifier apparatus and method of the present disclosure increases the density of a formed mat to achieve a uniform desired density. FIG. 2 shows a densified mat 9 made according to the present disclosure in which the fibers have been compressed evenly from the front edge 4 to the back edge 6 so as to provide a generally uniform density across the densified mat 9. For the purposes of the present disclosure, the term "across" means across the width W and between the front edge 4 to the back edge 6, or at least a portion of that distance. The terms "densified" and "compressed" are equivalent and mean an increased density of the fibers in the mat.

The main assemblies include a main frame, carriage frame assembly, and densifier assembly. The densifier assembly includes a densifying subassembly and a stripper subassembly.

Figure 3:
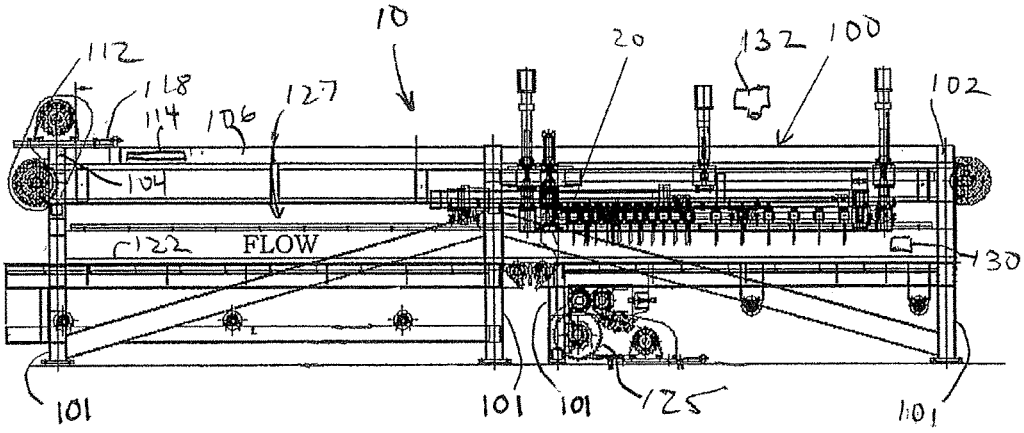
FIG. 3 is a side elevational schematic view of a first exemplary embodiment of an apparatus according to the present disclosure and showing the main subassemblies.

FIG. 3 shows one exemplary embodiment of an apparatus 10 having a main frame 100, densifier assembly 20 and carriage frame assembly 21.

Main Frame

Figure 4:
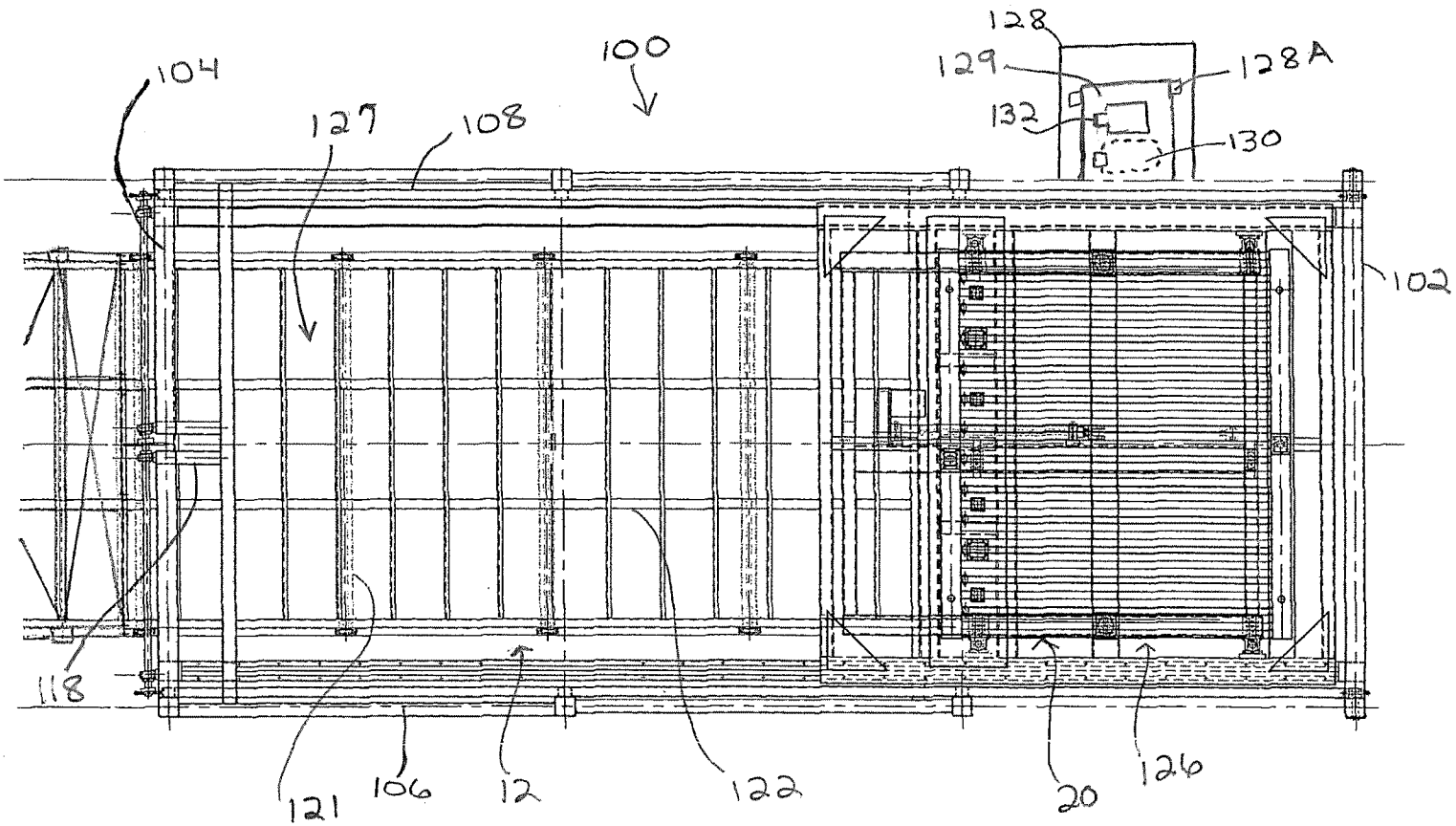
FIG. 4 is a top plan view of the apparatus of FIG. 3.

FIGS. 3-4 show one exemplary embodiment of an apparatus 10 and the basic structure of a main frame 100. The main frame has legs 101, front and back rails 102, 104, and opposing side rails 106, 108, each side rail may have a track 110 preferably inset in the top surface (as described further hereinbelow). The carriage frame assembly 21 rests on top of the main frame side rails 106, 108. The carriage frame 21 (including densifier assembly 20) is rolled in a reciprocating manner in the tracks 110 by at least one, and preferably a pair of carriage drive mechanisms 112, each of which includes a drive piston 114 connected at one end to a main frame side rail (e.g., rail 106) and at the other end to the carriage side frame member (e.g., frame member 82). Each piston 114 is connected to a drive motor 116. The main frame 100 also includes a back stop 118 an exit conveyor assembly 120, which may be, for example, a belt 122 associated with a pair (or more) of rollers 124 and a motor 125.

It is to be understood that in the present disclosure reference to air cylinders, pistons, actuators or other linear motion-inducing devices is intended to include other drive mechanisms, such as, but not limited to, pneumatic, hydraulic, belt, ball screw, chain drive, and the like. Such devices are also intended to include (if not specifically mentioned) associated valves, actuators, motors, PLC communication connections and the like normally associated with such devices for ordinary functioning. It is also to be understood that reference to a particular number of such devices is intended to include at least that number and the scope of the present disclosure include additional (or possibly fewer) units, unless otherwise specifically excluded.

The main frame 100 is divided into two main areas, a densification area 126 and a mat gathering area 127 (see FIG. 4). Mats 1 are introduced into the densifier assembly 20 at the densification area 126 by an introduction conveyor 128 (not shown) having an infeed belt 129 or by other conveyance means situated proximate to or abutting the main frame. Mats densified by the densifier assembly 20 are moved offline by the exit conveyor 120 toward the back stop for further processing.

Carriage Frame Assembly

Figure 5:
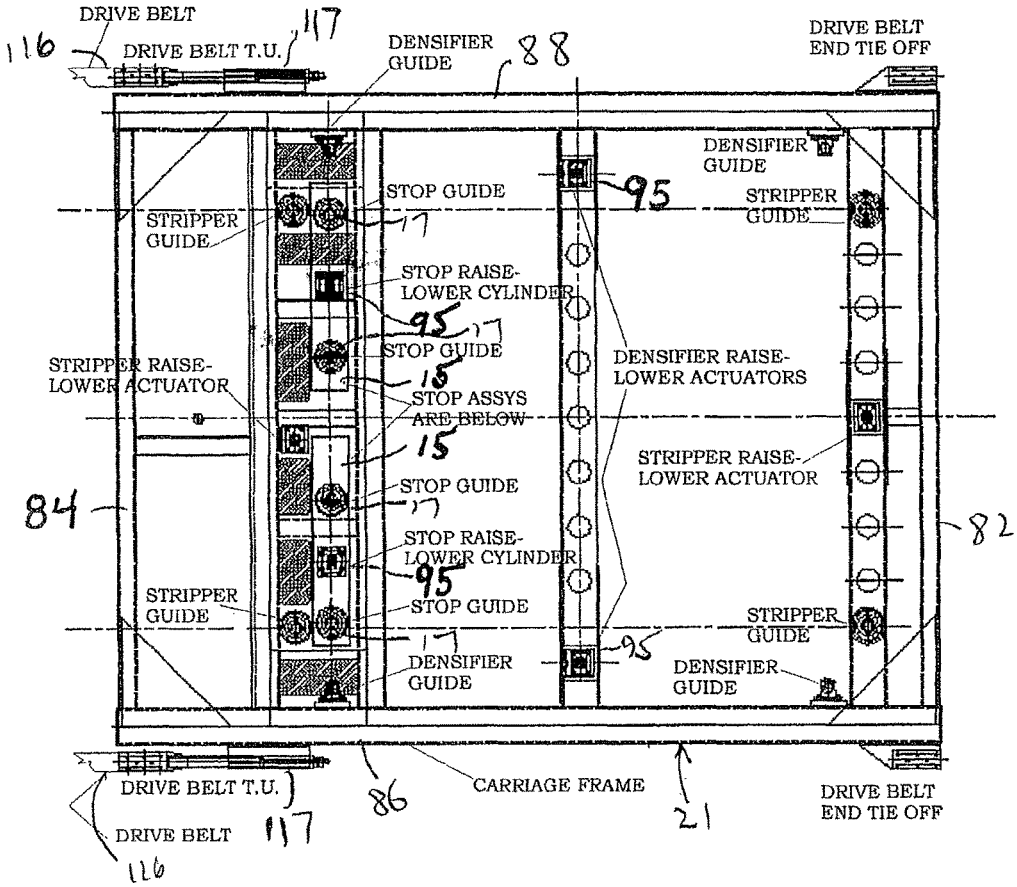
FIG. 5 is a top plan view of one embodiment of the carriage frame assembly.
Figure 6:
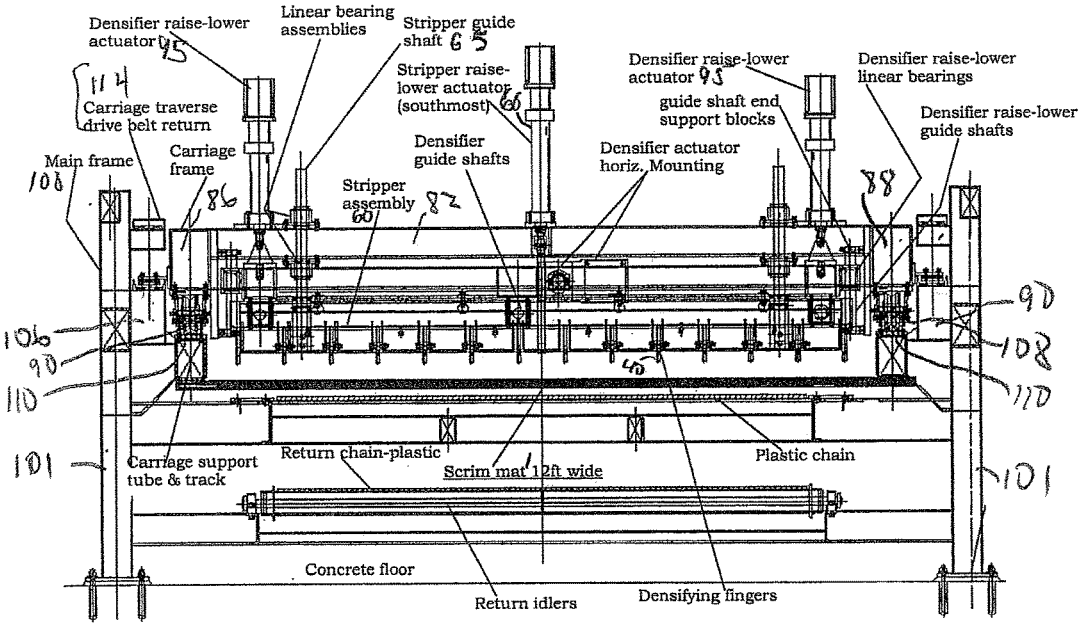
FIG. 6 is a north elevational view of a densifier assembly.
Figure 7:
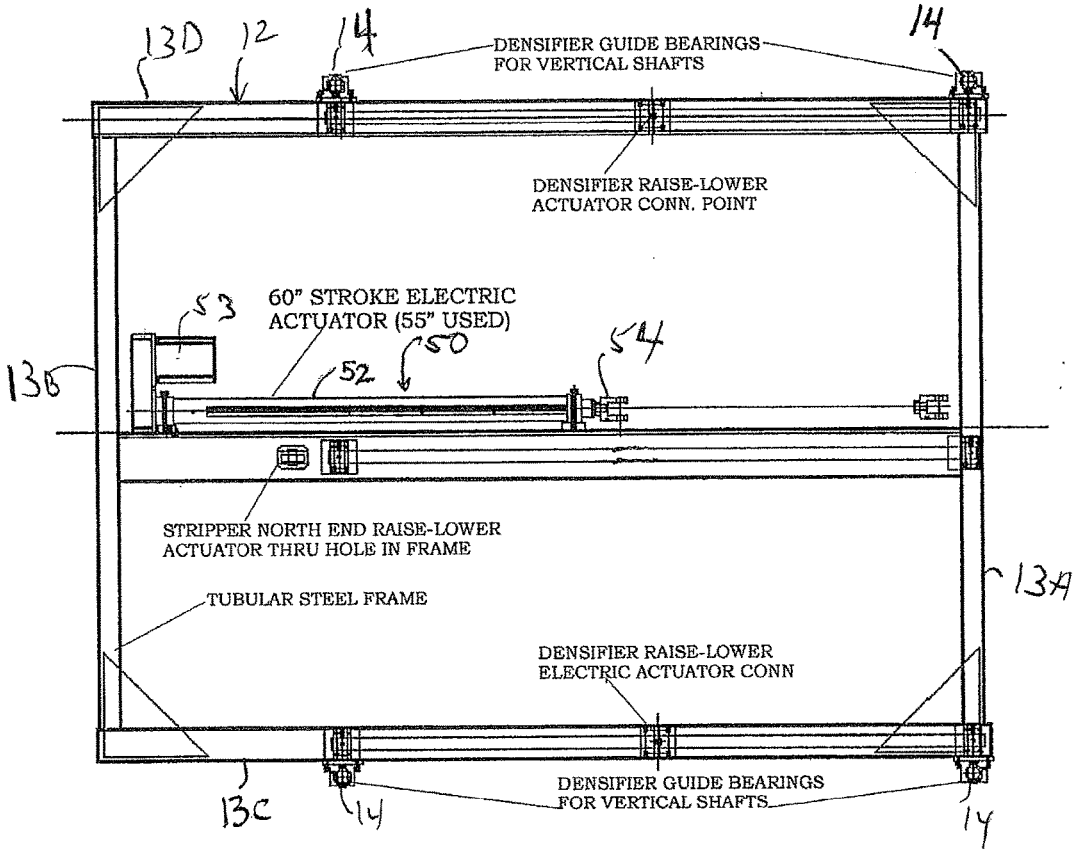
FIG. 7 is a top plan view of a portion of the densifier subassembly showing the frame and linear positioning actuator.
Figure 8:
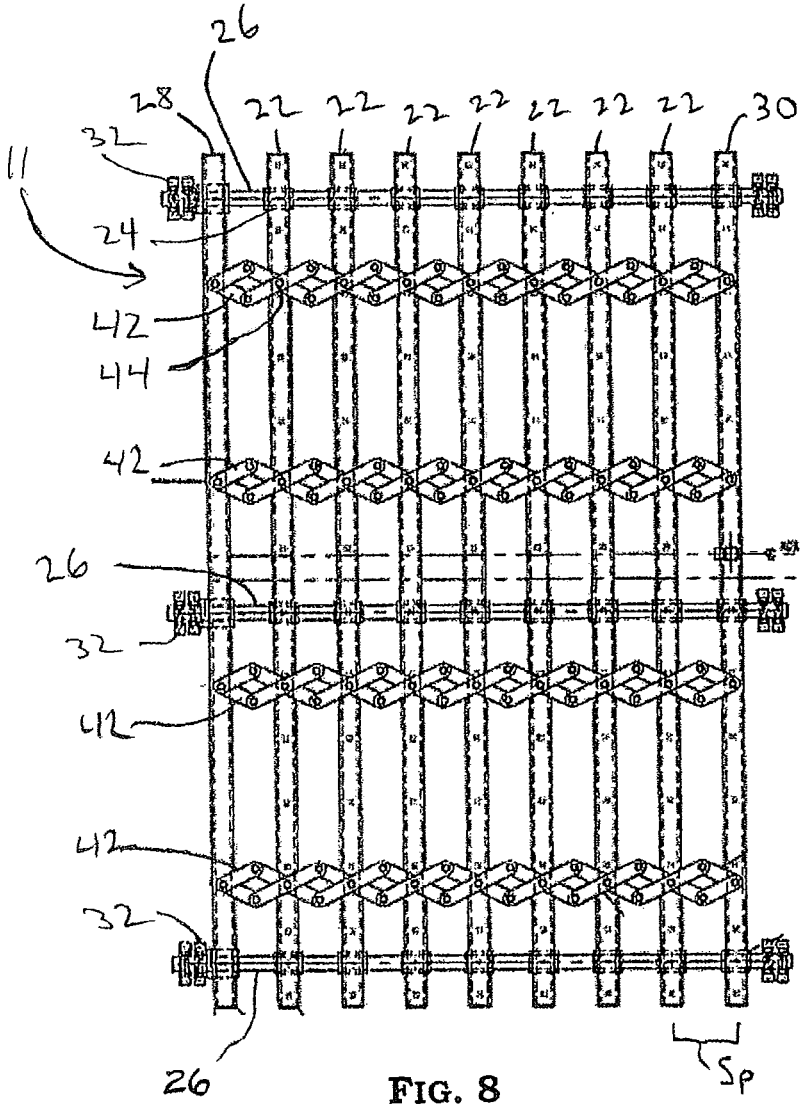
FIG. 8 is a top plan view of a portion of the densifier subassembly showing the accordion linkage and linear positioning assembly.
Figure 9:
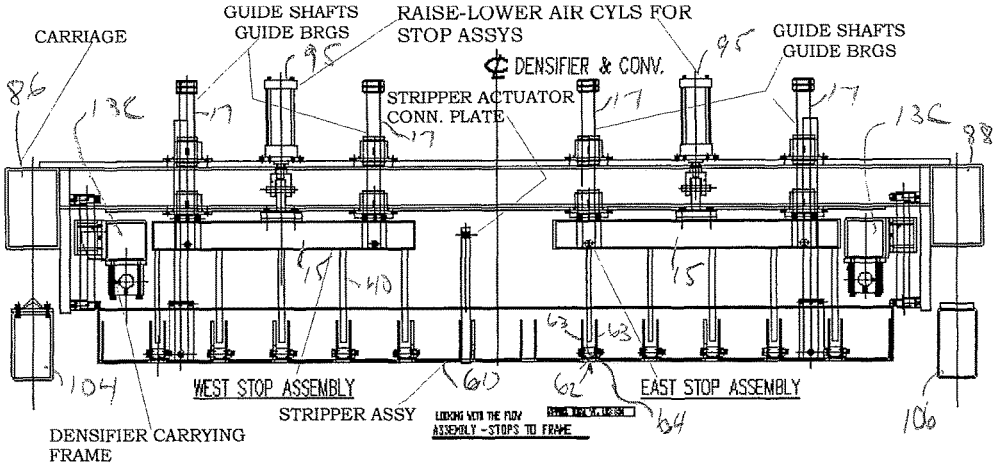
FIG. 9 is a side elevational view of a stop assembly for the densifying subassembly.

FIG. 5 shows a carriage assembly having a carriage frame 21 having front and rear frame members 82, 84 and side frame members 86, 88. Extending downward from each end of the side frame members 86, 88 are rollers 90 (each with an associated bearing 92, not shown) attached to a roller mount 94. It is to be understood that two or more rollers 90 may be spaced along the side frame members 82, 84 between the ends. The carriage frame 21 rests on top of and transversely (and reciprocatingly) rolls in the main frame side rail tracks 110 by means of a motor driven gear drive 114 mounted on the main frame 100 and associated with synchronous belts 116 attached to each side of the carriage frame 21. A belt take up 117 is located at either side of the carriage frame 21.

The carriage frame assembly 21 has mounted to it a pair of vertical raising and lowering actuators 95 and associated mechanism for raising and lowering the densifier assembly 20 in response to an electronic signal from the processor 140 (discussed in more detail hereinbelow). The carriage frame assembly 21 has also mounted to it a pair of actuators 66 and associated air valves for raising and lowering a stripper assembly 21. Thus, the densifier assembly 20 is raised and lowered with respect to the carriage frame assembly 21 so that a mat 1 can be positioned under the densifier assembly 20. The stripper subassembly 60 The carriage frame assembly can move horizontally on the main frame 100.

Densifier Assembly

The densifier assembly 20 consists generally of a densifying subassembly 19 and a linear stripper subassembly 60.

Densifying Subassembly

FIGS. 6-9 show a densifying subassembly 11 including a frame 12 comprised of front and rear rails 13A, 13B and opposing side rails 13C, 13D. The frame 12 also includes four or more vertically mounted shafts 14 and bearings, which are also mounted to the carriage frame assembly 21. The frame 12 can be raised or lowered with respect to the carriage frame assembly 21 by two or more vertical raising and lowering actuators 95 mounted on the carriage frame assembly 21.

The densifying subassembly 11 also includes a number of elongated passive densifying bars 22 (see FIG. 8) each have at least one and preferably several openings and associated bearing 24 at each end and preferably and an associated opening and bearing near the midpoint of each bar 22. The passive bars 22 are spaced apart and maintained in a generally parallel configuration by several shafts 26 which pass through the bearings 24 and openings and which are horizontally mounted to the front and rear rails 13A, 13B of the densifying subassembly 11. At each end of the shaft 26 is an end cap collar 32. The shafts 26 provide guidance and support for the passive bars 22. A static end bar 28 is positioned at the rear end of the densifying subassembly 11 and attached to a drive bar 30 which is movably positioned proximate to the front rail 13A. The bars 22 can be solid, or may be hollow tubing, C-shaped, L-shaped, U-shaped or other shaped elongated bent plates, and are preferably made of metal, plastic, alloy, combinations thereof or the like or other durable, generally rigid material. The drive bar 30 and the passive bars 22 can move reciprocatingly along a portion of the length of the shafts 26. The drive bar 30 and each passive bar 22 have a plurality of spaced apart downwardly extending pins 40.

The densifying subassembly 20 has at least one, and, in one exemplary embodiment, a plurality of extensible accordion linkages (also known as extensible scissors linkages) 42 spaced across the bars 22, 28, 30. In one embodiment the accordion linkages 42 are mounted on top of the bars 22, 28, 30. Each accordion linkage 42 is attached via at least one pin 44 to each bar 22, 28, 30. The accordion linkages 42 function to maintain the bars 22, 28, 30 in a generally equal spaced relationship; in other words, as the passive and drive bars 22, 30 are moved along the shafts 26 the accordion linkages 42 maintain the same relative distance between each bar 22, 30.

The densifying subassembly 11 includes at least one (two are shown in the drawings) stop assemblies 15 (see FIG. 9), which include stop blocks 16 which are mounted to the carriage frame assembly 21. A pair of guide shafts 17 and bearings are mounted to each stop block 16 on either side of the vertically mounted actuator 95 which raises and lowers the densifying subassembly 11.

Figure 10:
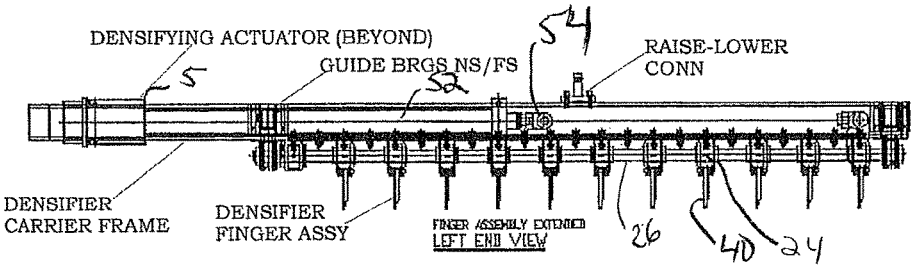
FIG. 10 is a side view of the densifying subassembly highlighting the linear positioner, with the accordion linkage extended.
Figure 11:
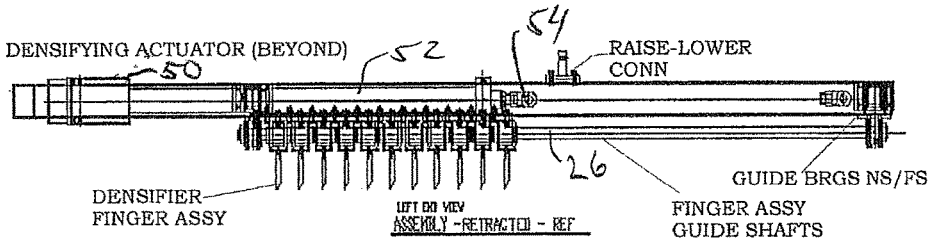
FIG. 11 is a side view of the densifying subassembly highlighting the linear positioner, with the accordion linkage retracted.

The passive and drive bars 22, 30 are moved along the shafts 26 by means of a linear positioning actuator 50 (see FIGS. 10-11). The linear positioning actuator 50 has a drive mechanism, such as, but not limited to, a ball-feed screw 52 and a drive motor 53. Alternatively, instead of a ball-feed screw 52 a piston can be used. The actuator 50 is connected at one end by a coupling 54 (such as, but not limited to, a clevis (shown in the drawing), eye hook or the like) to the drive bar 30 and at the other end to the rear rail 84 of the carriage frame assembly. The actuator moves the drive bar 30 and passive bars along the shafts 26 toward or away from the stop assemblies 15. The accordion linkages 42 maintain the passive bars 22 in a generally equal relative spacing (labeled as Sp in FIG. 8). It is to be understood that more than one linear positioning actuator can be included along the length of the densifying subassembly 11. If desired, the densifying subassembly 11 can be operated as a standalone apparatus separate from the conveyor apparatus.

Stripper Subassembly

Figure 12:
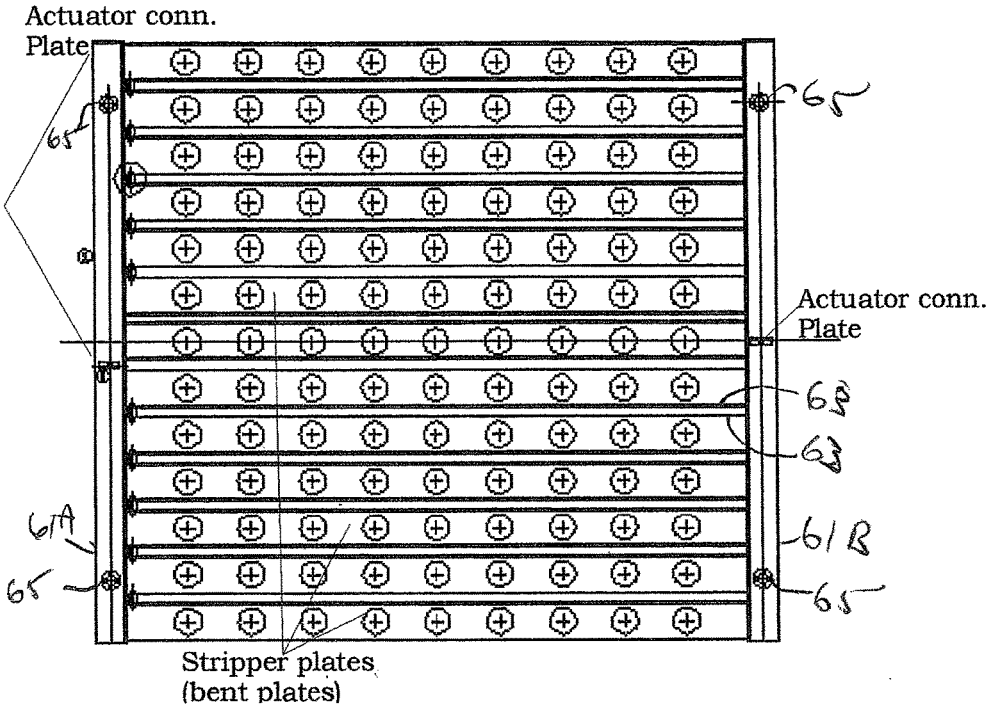
FIG. 12 is a top plan view of a stripper assembly.
Figure 13:
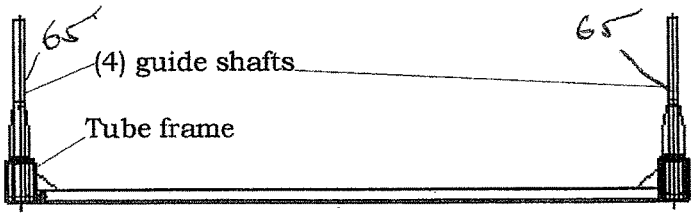
FIG. 13 is a side view of the stripper assembly.

The apparatus 10 may also include a stripper assembly 60 (see FIGS. 9, 12-13) to strip or scrape fibers and resin from the pins 40 after they have been removed from a densified mat 9. The stripper subassembly 11 includes a frame having a pair of side frame members 61A, 61B. Also included are a number of stripper surfaces 62 comprising elongated bent L-shaped plates 63 (see FIG. 9) which are mounted on the side frame members 61A, 61B. The plates 63 may be mounted so that pairs of adjacent plates 63 have the vertical part of the L shape back-to-back and the horizontal part of the L shape are opposing in two adjacent pairs of plates 63. The pins 40 pass through the gaps 64 between adjacent plates 63.

In an alternative embodiment, rather than being L-shaped plates, the strippers may be generally flat elongated plates which have holes or openings in which the pins 40 may be inserted or removed. The holes are sized to be close in diameter to the diameter of the pins 40 so that when the pins are removed from the densified mat the pins 40 pass through the holes and the edge of the hole scrapes extraneous matter (e.g., fibers and resin) from the pins 40. Alternatively, other configurations of stripper devices can be used, such as doctor blades, spring mounted flexible pieces of materials (e.g., metal), brushes, scrapers or the like.

The stripper subassembly 60 can be vertically raised and lowered and guided by vertically mounted shafts 65 and bearings which are attached to the top of the carriage frame assembly rails 86, 88 and driven by a pair of actuators 66 mounted on the carriage frame assembly 21.

Figure 14:
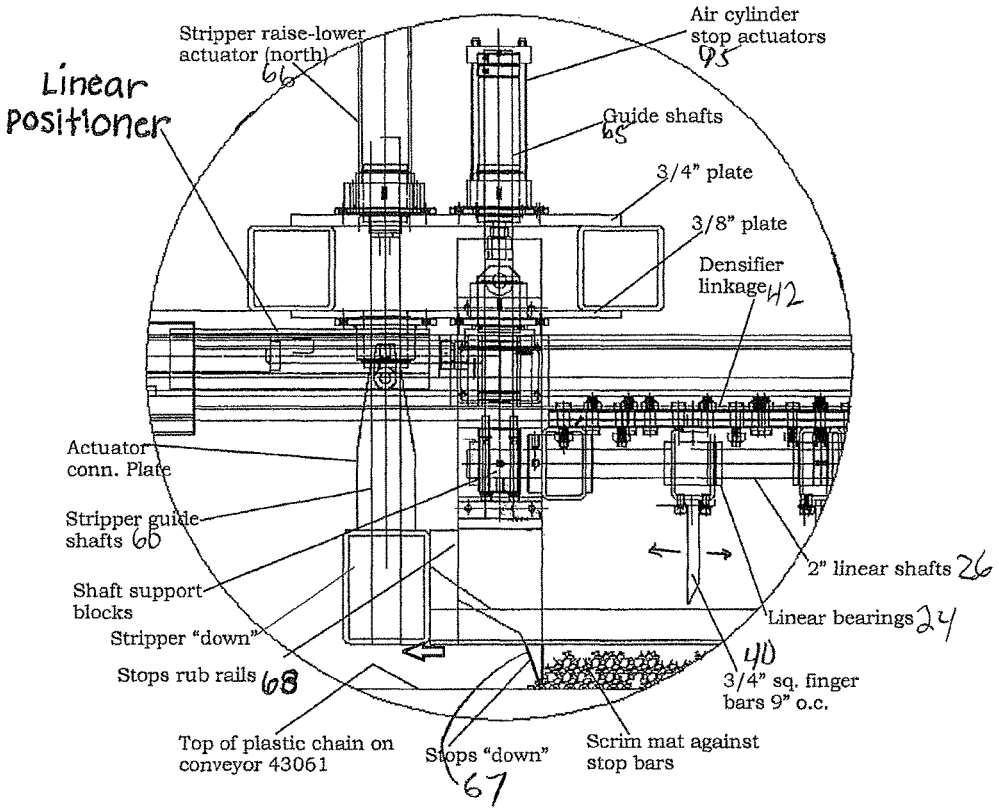
FIG. 14 is a side detail view of a portion of the stripper and densifying subassemblies.

As shown in FIG. 14, a stop bar 67 is a stop that is lowered when a mat 1 is entering the densifier assembly 20 on the infeed belt 129 and raised to discharge a compressed mat 9. Stop rub rails 68 are guides used for guiding the stop bar 67 up and down.

During the densification process mat fibers may stick to the pins 40. The stripper subassembly helps to remove mat fibers from the pins 40 when the pins 40 are removed from a densified mat 9. When the pins 40 are withdrawn from a mat they pass through the stripper surfaces 62, which scrape off the fibers from the pins 40. The densifying subassembly 11 and stripper subassembly 60 can be raised and lowered independently of each other. The stripper subassembly 60 is mounted on the carriage frame assembly 21 and the densifying subassembly 11 is mounted above the stripper subassembly 60 on the carriage frame assembly 21.

The relative movement of the assemblies and subassemblies with respect to the main frame 100 is described as follows. The carriage frame assembly 21 itself can move horizontally on the main frame 100. The densifier assembly 20 can be raised and lowered with respect to the carriage frame assembly 21 so that a mat 1 can be positioned under the densifier assembly 20. The stripper subassembly 60 can be raised and lowered independently of the densifying subassembly 11 so that the pins 40 can be stripped of extraneous material.

Measuring Sensors and Logic Control

An infeed conveyor assembly 128 (see FIG. 4) includes a conveyor 128A and an infeed belt 129. A weight sensor 130 is positioned under the infeed belt 129 to the densifier assembly 20 and weighs each mat 1 as it enters the densifier assembly 20. A surface area detector 132, such as a camera, CCD device, or the like, is positioned above the infeed belt and is used to calculate the surface area of each mat 1 at the same time it is being weighed.

A programmable logic controller ("PLC") 140 (not shown) is in electronic communication with the linear positioning drive motor 58, densifier assembly vertical positioning cylinders 95, the linear positioning assembly drive motor(s) 58, the stripper subassembly actuators 66, the carriage drive motors 116, and/or various other components. The PLC 140 is also in communication with the weight sensor 130 and the surface area detector 132. Preferably, the PLC 140 includes a user interface control panel 142 (not shown) for programming and operating the PLC 140.

Exemplary Method

Figure 15:
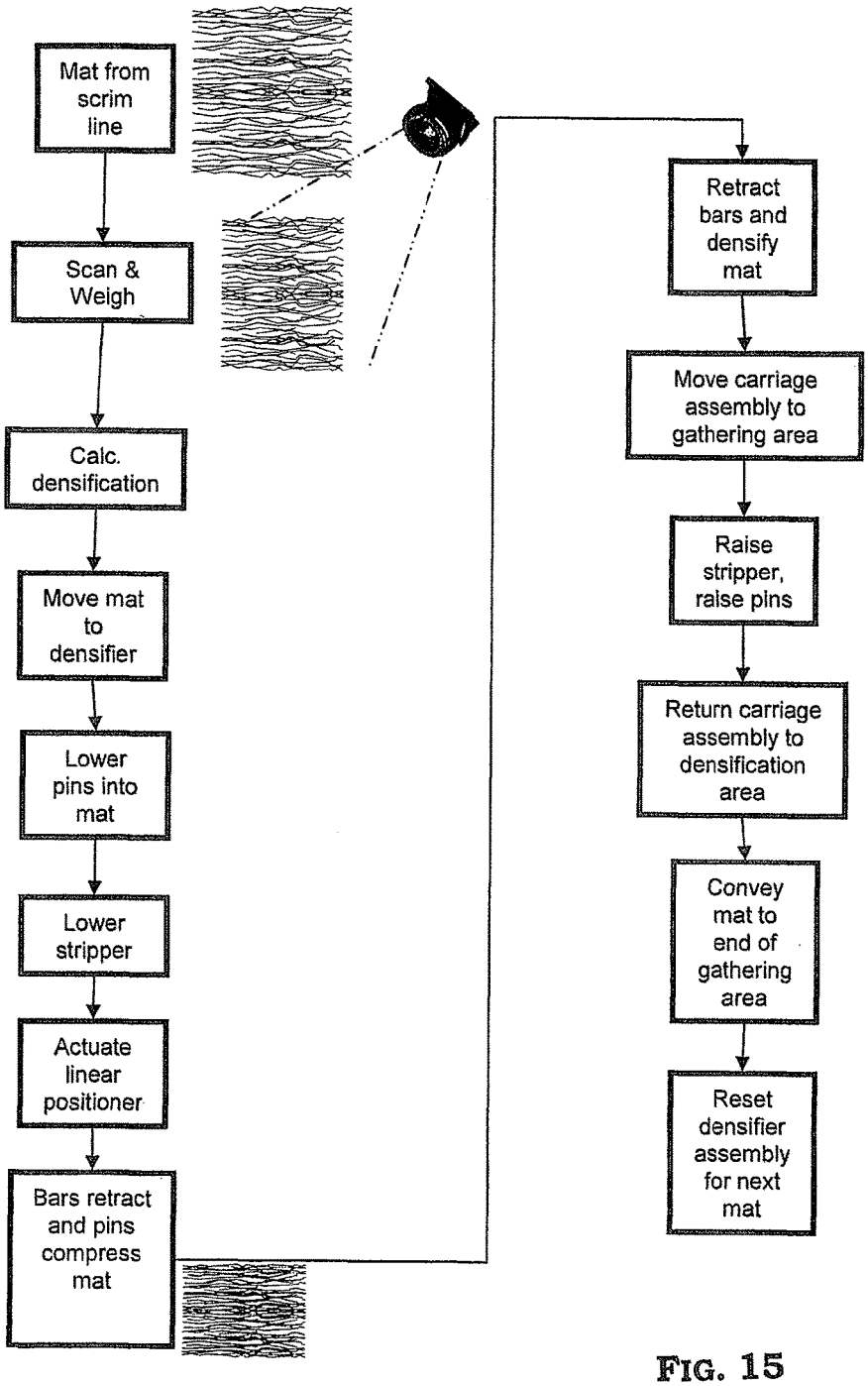
FIG. 15 is a flow diagram of one exemplary method for densifying a fibrous mat.

One exemplary method of densifying a mat 1 using the apparatus 10 of the present disclosure is now described, with reference to the flow diagram shown in FIG. 15. Each densifying operation starts with an uncompressed mat 1 and produces a compressed mat 9 which can be positioned next to other compressed mats which are further processed. The overall process may be considered a continuous batch process.

The mat 1 is introduced by the infeed belt 129 and is weighed by the weight sensor 130 and scanned (for surface area) by the surface area detector 132. From this information the PLC 140 calculates the amount of densification needed to achieve the desired mat density. The PLC 140 determines the distance the linear positioning screw 54 must travel and the distance the drive bar 30 must travel to compress the mat 1.

The mat 1 is fed to the densification area 127 underneath the densifier assembly 20 by the introduction conveyor 128. The mat 1 is oriented on end with the fibers 2 being in a direction generally parallel to the bars 22. The mat 1 may have variable fiber density across the mat prior to densification, such as lower fiber density areas 7 and higher fiber density areas 8. The densifier assembly 20 is initially configured so that the distance between the drive bar 30 and the static bar 28 is roughly the width W of the mat 1. The densifier assembly 20 is raised and lowered by the vertical actuators 95 so that the pins 40 are pushed into or removed from the fibers 2.

The linear positioning actuator 54 is actuated by the PLC 140 and the drive bar 30 is drawn toward the stop block. The passive bars 22 move simultaneously, with the accordion linkages 42 maintaining the same relative spacing "Sp" between the bars 22 as the distance between the bars decreases. The pins 40 push and compress the individual fibers (or bundles of fibers) together uniformly.

One feature of the presently described apparatus and method is that the result of having all the pins 40 on all the passive bars 22 and drive bar 30 moving the same proportionate distance at the same time is that substantially the entire mat 1 (from the front edge 4 to the rear edge 6) is compressed by the same amount. Thus, the density of the densified mat 90 is now essentially uniform across the width W of the mat. This is in contrast to prior densification apparatus, which typically sandwich the mat between two external plates which drive the front edge toward the rear edge.

After the mat 1 (now identified as densified mat 9) is compressed to the desired width, the carriage frame assembly 21, with densifier assembly 20 (and a mat 9 with the pins 40 still inserted therein), rolls on the main frame side rails 106, 108 in response to actuation of the main frame side rail pistons 114 and away from the densification area 127 and onto the exit conveyor 120. The stripper subassembly 60 is raised just prior to raising the pins 40. The densifier assembly 20 is raised by the actuators 95 and the pins 40 are removed from the mat fibers 2. The carriage frame assembly 21 is moved horizontally back to the densification area 126 for processing of the next mat 1. The densified mat 9 is conveyed toward the back stop 118 which has a gathering area 127 at the end of the conveyor 120. Densified mats 9 are crowded together and accumulated in this gathering area 127. These sets of mats 9 can be further processed, such as cut and stacked. The process is repeated with the next mat 1 being fed into the densification area 126.

The following describes one nonlimiting example of the method described above using an example of measurements and calculations to illustrate the densification determination. The surface area detector 132 scans the surface area of the mat 1. The square footage determines the "starting" width of the mat 1. The PLC 140 actuates the linear positioning actuator 50 and sets the initial spread of the pins 40 so that all the rows of pins 40 are in the fibers 2. The PLC 140 is programmed and preset for a given mat width or density.

A 30 inch wide by 9 foot long mat (22.5 sq ft) may weigh about 65 lbs. The PLC 140 calculates the starting density from these numbers as being 3.0 lb/sq. ft. A desired end density, e.g., 3.4 lb/sq. ft, is programmed into the PLC 140. Accordingly, the surface area needs to be compressed from 22.5 sq. ft down to 19.1 sq. ft to achieve this density. The width W needs to be compressed 4.5 inches, i.e., from 30 inches wide to 25.5 inches wide. The PLC 140 actuates the linear positioning actuator 50 to move the drive bar 4.5 inches. The accordion linkage 42 retracts and pins 40 drive and compress the fibers 2 substantially evenly across the mat 1 to achieve the desired width and thus the desired density. It is to be understood that compression, while occurring substantially evenly, may still result in areas of small density variation across the width of the mat.

A feature of the presently described densification method and apparatus is that the densified mat 9 stays densified after the pin force is released. If the mat had been compressed only by squeezing the front and rear mat edges 4, 6 toward each other, the mat 9 would tend to decompress because it was not compressed uniformly.

The densified mat 9 formed by the apparatus and method of the present disclosure has a more uniform density and moisture content across the width W of the mat than has been achievable by other known techniques. The density of the mat to be formed by the apparatus and method described herein can be selected by the apparatus operator. The density variation can be The apparatus and method of the present disclosure can be adapted for use with materials other than crushed wood mats and the densifier assembly can be used to increase the density of any of a variety of materials which can accommodate the pins 40. The densifier assembly 20 can be adapted to have the pins 40 be marking "fingers" and used to create a set of rows of marks across a mat or sheet of material. Alternatively, rather than pins, lasers, cutters or drill bits can be substituted so that a set of uniform and controllable width rows of holes can be created in a sheet of material, such as steel, by having the hole-creating devices lowered onto the sheet of material from above. The apparatus 10 can be adapted for creating a uniform density of large foam or cotton particles in creating mattresses or other articles requiring a uniform density of material and where the pins 40 can be inserted into and removed from the material to be densified.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

The headings of various sections are used for convenience only and are not intended to limit the scope of the present disclosure.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods, equipment and systems. These and other components are disclosed herein, and it is understood that when combinations, subsets, interactions, groups, etc., of these components are disclosed that while specific reference of each various individual and collective combinations and permutation of these may not be explicitly disclosed, each is specifically contemplated and described herein, for all methods, equipment and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following inventive concepts.

It should further be noted that any patents, applications and publications referred to herein are incorporated by reference in their entirety.

The invention claimed is:

1. A method for increasing the density of a fibrous mat, the mat fibers having a face and a grain defined as a direction of the face of the mat, the method comprising:

(a) inserting a plurality of rows of pins in the mat, the pins being maintained in spaced apart relationships by a plurality of bars, each bar having a plurality of spaced apart pins associated therewith and extending downward therefrom, each bar being associated with an accordion linkage adapted to maintain each row of elongated bars in a generally parallel relationship to each other and permitting the distance between the bars to expand or contract proportionately so that a spacing between the rows of bars is equal while an overall spacing between adjacent bars increases or decreases; and, (b) moving the rows of pins so that the spacing between the rows decreases by the same amount so as to compress the mat fibers between the rows of pins uniformly across the grain of the mat to compress the mat in a direction across the face of the mat and generally uniformly along the length of the mat so as to obtain a compressed mat having a substantially uniform density.

2. The method of claim 1, further comprising a step (c) removing the pins from the mat so as to be insertable in another mat.

3. The method of claim 1, wherein each row of pins is associated with and extends downward from a movable bar, each bar being associated with a drive member adapted to move the bar in a linear direction.

4. The method of claim 3, wherein each bar is associated with at least one reciprocatingly extendable and retractable accordion linkage arranged generally parallel to each other and generally perpendicular to the bar, each accordion linkage being associated with at least one point on each bar, the at least one accordion linkage being adapted to maintain each of the bars in a generally parallel relationship to each other and permitting the distance between the bars to expand or contract proportionately so that the spacing between the bars is equal while the overall spacing between adjacent bars increases or decreases.

5. The method of claim 1, further comprising a step of weighing the mat using at least one weight detection device to obtain weight data.

6. The method of claim 5, further comprising a step of scanning the mat with at least one detection device adapted to detect the surface and edges of the mat so to obtain square footage data of the mat.

7. The method of claim 6, further comprising a step of determining from the weight and square footage data a densification value indicating how much the mat is to be compressed.

8. The method of claim 7, further comprising a step of signaling a drive member in mechanical communication with the rows of pins a distance based on the densification value to cause the rows of pins to be moved so as to compress the mat fibers a predetermined amount.

9. The method of claim 2, further comprising a step of stripping at least one of the pins of debris that may have clung to the pin.

10. The method of claim 9, wherein the stripping is achieved by providing a stripper subassembly comprising a stripper subassembly frame;

a plurality of stripper members associated with the stripper subassembly frame and aligned with the rows of pins;

a plurality of gaps defined in the stripper members, a pin being insertable into and removable from a gap; and, at least one stripper subassembly actuator for raising and lowering the stripper subassembly frame and stripper members with respect to the rows of pins such that the stripper members are proximate to the pins and strip the pins of debris when the pins pass through the gaps.

11. The method of claim 10, wherein each stripper member comprises a pair of L-shaped plates, each pair comprising a first elongated generally L-shaped plate and a second elongated generally L-shaped plate, the first and second plates being mounted to the stripper subassembly frame in pairs with the vertical segment of one first L-shaped plate being parallel and adjacent to the vertical segment of one second L-shaped plate so as to form a gap between the pair of L-shaped plates such that a row of pins can be inserted and removed from the gap and the pair of L-shaped plates being spaced so as to scrape extraneous matter from the pins when the pins pass into the gap.

12. The method of claim 10, wherein each stripper member comprises a generally flat horizontal plate mounted to the stripper subassembly frame, the plate having a plurality of holes defined therein, each hole being sized to accommodate a pin such that extraneous matter can be scraped by the plate edge forming the hole when a pin is passed through the hole.

13. The method of claim 2, further comprising a step of moving the compressed mat toward a location for stacking a plurality of compressed mats.

14. A method for increasing the density of a fibrous mat, the mat fibers having a face, surface and edges, and a grain defined as a direction of the face of the mat, the method comprising:

scanning the mat with at least one detection device adapted to detect the surface and edges of the mat so to obtain square footage data of the mat;

determining from a weight of the mat and the square footage data a densification value indicating how much the mat is to be compressed;

inserting a plurality of rows of pins in the mat, wherein each row of pins is associated with and extends downward from a movable bar, each bar being associated with a drive member adapted to move the bar in a linear direction, wherein each bar is associated with at least one reciprocatingly extendable and retractable accordion linkage arranged generally parallel to each other and generally perpendicular to the bar, each accordion linkage being associated with at least one point on each bar, the at least one accordion linkage being adapted to maintain each of the bars in a generally parallel relationship to each other and permitting the distance between the bars to expand or contract proportionately so that a spacing between the bars is equal while an overall spacing between adjacent bars increases or decreases;

signaling at least one drive member in mechanical communication with each bar, the at least one drive member adapted to move the bars with the row of pins associated with each bar;

moving the rows of pins so that the spacing between the rows decreases by the same amount so as to compress the mat fibers between the rows of pins uniformly across the grain of the mat to compress the mat in a direction across the face of the mat and generally uniformly along the length of the mat so as to obtain a compressed mat having a uniform density; and, removing the pins from the mat and resetting the rows of pins so as to be insertable in another mat.

* * * * *